US007161134B2

(12) United States Patent
Cure et al.

(10) Patent No.: US 7,161,134 B2
(45) Date of Patent: Jan. 9, 2007

(54) PROCEDURE FOR SCANNING IDENTIFYING BADGES FOR AUTOMOTIVE VEHICLE

(75) Inventors: David Cure, Créteil cedex (FR); Marie-Pierre Bena, Paris (FR); Marc Ranier, Villenéuve le Roi (FR); Kathleen Dechamps, Choisy le Roi (FR); Jacques Morillon, Massy (FR)

(73) Assignee: Valeo Electronique, Creteil (FR)

( * ) Notice: Subject to any disclaimer, the term of this patent is extended or adjusted under 35 U.S.C. 154(b) by 198 days.

(21) Appl. No.: 10/506,011

(22) PCT Filed: Mar. 6, 2003

(86) PCT No.: PCT/EP03/02255

§ 371 (c)(1),
(2), (4) Date: Aug. 30, 2004

(87) PCT Pub. No.: WO03/077207

PCT Pub. Date: Sep. 18, 2003

(65) Prior Publication Data

US 2005/0218349 A1 Oct. 6, 2005

(30) Foreign Application Priority Data

Mar. 8, 2002 (FR) ..... 02 02970

(51) Int. Cl.
*H01J 40/14* (2006.01)

(52) U.S. Cl. ..... 250/221; 250/566

(58) Field of Classification Search ..... 250/559.4, 250/559.44, 221, 556

See application file for complete search history.

(56) References Cited

U.S. PATENT DOCUMENTS

| | | | | |
|---|---|---|---|---|
| 4,070,584 A * | 1/1978 | Chartraire et al. | ..... | 250/555 |
| 5,499,022 A | 3/1996 | Boschini | | |
| 5,552,641 A | 9/1996 | Schneider et al. | | |

FOREIGN PATENT DOCUMENTS

| | | |
|---|---|---|
| DE | 199 14 111 A | 9/2000 |
| EP | 0 965 710 A | 12/1999 |
| EP | 1 143 090 A | 10/2001 |
| EP | 1 172 269 A | 1/2002 |

* cited by examiner

*Primary Examiner*—Que T. Le
(74) *Attorney, Agent, or Firm*—Berenato, White & Stavish

(57) ABSTRACT

A procedure for scanning identifying badges for automotive vehicle comprising an identification device designed for the remote interchange of data with the identifying badges. The badge scanning comprises the repeated transmission, by the identification device, of identification requests for the attention of the badges. This procedure comprises the steps of detection (24) of a triggering event out of a predetermined set of triggering events; execution (26) of a preliminary test following the detection of the triggering event; and execution (28, 30) of at least one scan, according to the result of the preliminary test.

21 Claims, 2 Drawing Sheets

PROCEDURE FOR SCANNING IDENTIFYING BADGES FOR AUTOMOTIVE VEHICLE

BACKGROUND OF THE INVENTION

1. Field of the Invention

The present invention relates to a procedure for scanning identifying badges.

More specifically, the invention relates to a procedure for scanning identifying badges for an automotive vehicle of the type comprising an identification device suitable for the remote interchange of data with the identifying badges, the badge scan comprising the repeated transmission, by the identification device, of identification requests for the attention of the badges.

2. Description of the Prior Art

Generally, such a scanning procedure comprises the periodic transmission, for example once a second, of an identification request within a predetermined vicinity of the automotive vehicle. This identification request is sent in the form of a low frequency radio wave.

However, this periodic transmission consumes energy from the battery of the vehicle and from the batteries of the identifying badges. Furthermore, a limit on the transmission of low frequency radio waves is imposed by medical standards.

To limit the consumption of the procedure and the transmission of radio waves, it is possible to use the transmission of shorter and therefore less energy-intensive identification requests. The transmission can also be performed in unencrypted mode, but in this case, the procedure is less secure.

The invention aims to overcome the drawbacks of a conventional scanning procedure, by creating a procedure capable of sending identification requests in a secure way and by consuming less energy.

SUMMARY OF THE INVENTION

The subject of the invention is therefore a procedure for scanning identifying badges for an automotive vehicle of the aforementioned type, characterized in that it comprises the following steps:

- detection of a triggering event out of a predetermined set of triggering events;
- execution of a preliminary test, following the detection of the triggering event; and
- execution of at least one scan out of a set of possible scans, according to the result of the preliminary test.

Thus, the scan is executed only when certain conditions are satisfied, these conditions being verified using the preliminary test. This limits the duration of the scanning step which is the most energy-intensive step, and therefore enables effective protection of the requests sent to be maintained, while consuming little energy from the vehicle battery or from the badge batteries.

The procedure for scanning identifying badges according to the invention can, moreover, include one or more of the following features:

- the scan is executed for the purpose of automatically locking or starting the automotive vehicle, the identification device being linked to a central control unit designed to control the automatic locking means and the starting means of the automotive vehicle;
- the scan is executed in at least one area out of a set of predetermined areas;

- the preliminary test includes a test concerning the presence of at least one identifying badge in at least one area out of the set of predetermined areas;
- the preliminary test includes a test relating to the open or closed state of the openings of the automotive vehicle;
- the set of predetermined areas comprises a first area located in a vicinity near to the identification device, a second area corresponding to the passenger compartment of the automotive vehicle and a third area covering a given vicinity of the automotive vehicle;
- the set of possible scans comprises a scan in the first area, a scan in the second area and a scan in the third area;
- the predetermined set of triggering events comprises the stopping of the engine of the automotive vehicle, the opening of at least one opening of the automotive vehicle, the closing of at least one opening of the automotive vehicle if the latter is unlocked or locked from the inside, the unlocking of at least one opening of the automotive vehicle, the locking from the inside of at least one opening of the automotive vehicle and a reset of the central control unit to the initial state, if a scan was in progress before this reset to the initial state;
- the preliminary test includes a step for verifying the execution conditions of a scan, these conditions comprising the stopped state of the engine of the automotive vehicle and the unlocked or locked from the inside state of the automotive vehicle;
- it also includes a step for detecting an event temporarily stopping the scan and a step for detecting an event permanently stopping the scan;
- the set of temporary stop events comprises the detection of an identifying badge in the first scan area, the reception by the central control unit of an action request considered by the latter to take priority over the current scan, the opening of an opening of the automotive vehicle, the closing of an opening of the automotive vehicle if the latter is unlocked or locked from the inside and the detection of the disappearance of an identifying badge from the first scan area;
- the set of permanent stop events comprises the detection of a battery charge level on at least one identifying badge below a predetermined threshold, the detection of the end of a time delay initiated following a hands-free type locking of the automotive vehicle, the detection of an instant of transition to an engine running state of the automotive vehicle and the disappearance of all the identifying badges from the scan areas;
- if the conditions for executing a scan are verified, if all the openings of the automotive vehicle are closed and if at least one identifying badge is detected in the third scan area, the execution of a scan in the first and third areas is initiated;
- the execution of a scan in the first scan area is initiated, if the conditions for executing a scan and the following conditions are verified:
  - all the openings of the automotive vehicle are closed, at least one identifying badge is detected in the second and third areas and no badge is detected in the first area; or
  - at least one opening of the automotive vehicle is open and no identifying badge is detected in the first area; and
- an authentication of a badge located in the first scan area is performed on executing a scan, if and only if no identifying badge has been authenticated previously.

BRIEF DESCRIPTION OF THE DRAWINGS

It will be seen that the openings mainly comprise the doors and the trunk lid of the automotive vehicle.

The invention will be better understood using the description which follows, given only by way of example and described with reference to the appended drawings, in which.

DETAILED DESCRIPTION OF THE INVENTION

Figure 1:
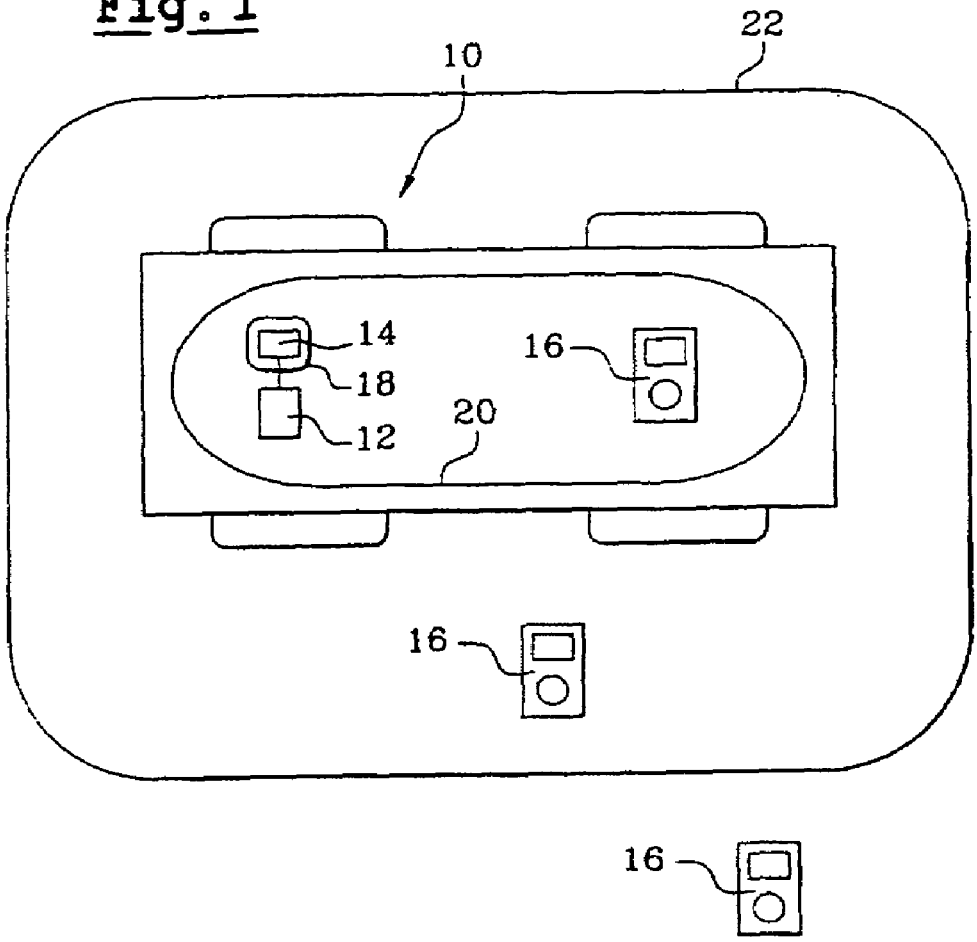
FIG. 1 schematically represents an automotive vehicle equipped for the implementation of a procedure according to the invention, seen from above.

The automotive vehicle 10 represented in FIG. 1 comprises a central control unit 12 arranged inside the passenger compartment of the automotive vehicle and linked to an identification device 14 suitable for the remote interchange of data with identifying badges 16 located in predefined scan areas.

The identification device 14 typically comprises a transponder-based identifying badge reader. Thus, when an identifying badge 16 is inserted into the reader, the latter locates it in a first scan area 18 located in a vicinity near to the identification device 14.

Furthermore, the reader is linked to antennas located inside and outside the automotive vehicle 10, for the purpose of interchanging data by low frequency radio waves with the identifying badges 16, when the latter are located in wider scan areas than the first area 18.

Thus, the identification device 14 can detect the presence of identifying badges 16 in a second area 20 corresponding to the volume occupied by the passenger compartment of the automotive vehicle 10, and in a third area 22 covering a given vicinity of the automotive vehicle 10.

It will be noted that the first area 18 is included in the second area 20, which is in turn included in the third area 22.

Figure 2:
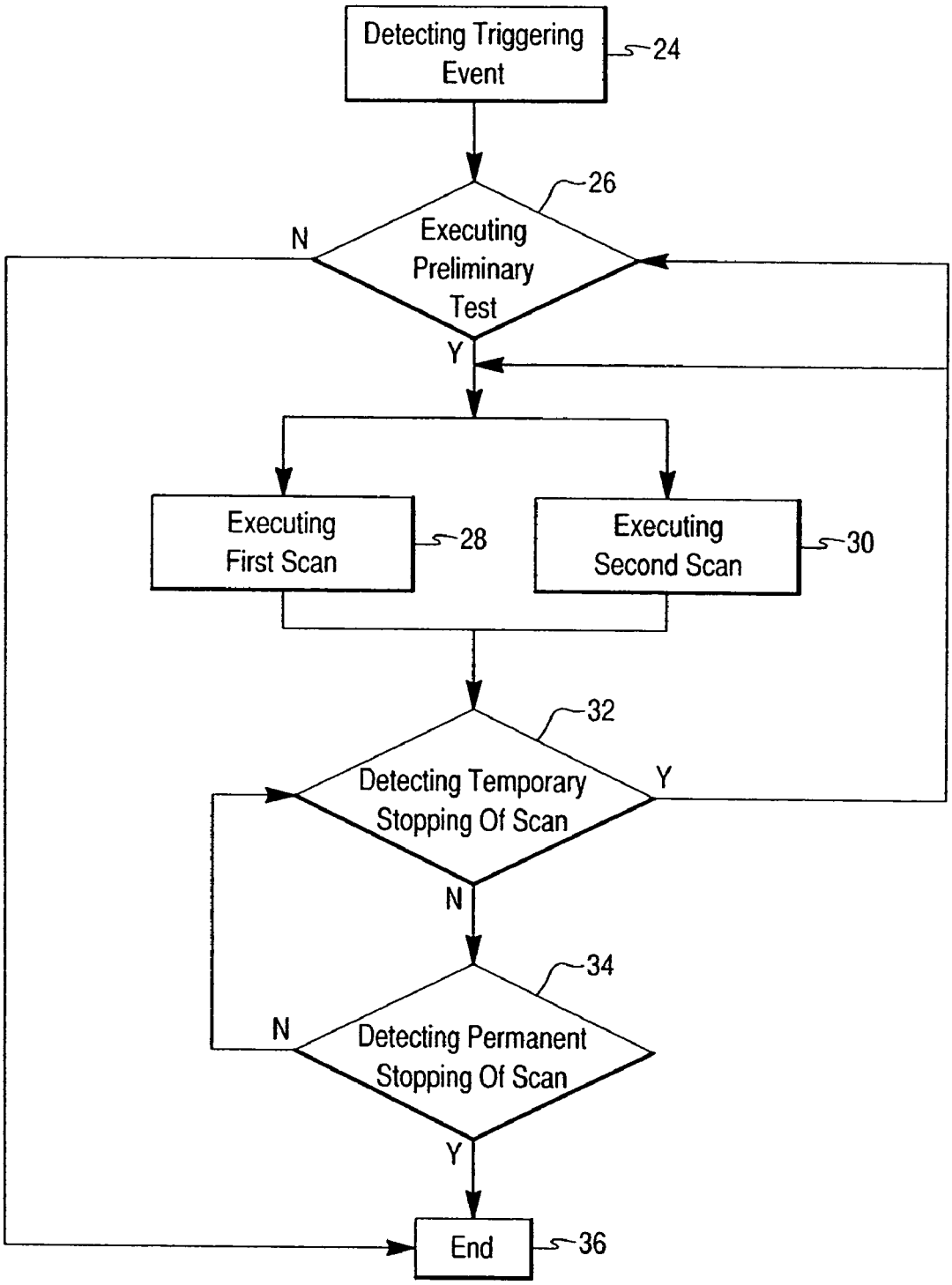
FIG. 2 represents the steps of a scanning procedure according to the invention.

The scanning procedure represented in FIG. 2 and implemented in the automotive vehicle 10 comprises a first step 24 for detecting a triggering event out of a predetermined set of triggering events.

The set of triggering events comprises:

stopping of the engine of the automotive vehicle 10;

opening of at least one door of the automotive vehicle 10;

closing of at least one door of the automotive vehicle 10 if the latter is unlocked or locked from the inside;

unlocking of at least one door of the automotive vehicle 10;

locking from the inside of at least one door of the automotive vehicle 10; and resetting of the central control unit 12 to the initial state, on a power line disturbance for example, if a scan was in progress before this reset to the initial state.

Then, in a step 26, the central control unit 12 runs a preliminary test.

This preliminary test comprises:

verification that the conditions for executing a scan are satisfied;

an identification request sent by the identification device 14 for the attention of the identifying badges 16 located in at least one of the first, second or third scan areas 18, 20 and 22; and a test concerning the open or closed state of the openings of the automotive vehicle 10.

The conditions for executing the scan are:

the engine is stopped; and the automotive vehicle is unlocked or locked from the inside.

Depending on the result of this preliminary test, the procedure goes on to a step 28, during which the identification device 14 starts executing a first scan, to a step 30, during which the identification device 14 starts executing a second scan, or to a step 36 for stopping the scanning process.

Steps 28 and 30 will be detailed later.

The first scan step 28 is selected if, and only if, the execution conditions are satisfied, all the openings of the automotive vehicle 10 are closed and at least one identifying badge 16 is detected in the third area.

Otherwise, in the event of the scanning procedure being implemented in the automotive vehicle 10 only for the purpose of automatically locking it, if these conditions are not satisfied, the procedure goes on to step 36 for stopping the procedure.

However, if the scanning procedure is implemented in the automotive vehicle 10 with a view to locking it or starting it, the procedure goes on to the second scan step 30 if and only if the execution conditions and the following conditions are satisfied:

all the openings of the automotive vehicle 10 are closed, at least one identifying badge 16 is detected in the second and third areas and no badge is detected in the first area; or at least one opening of the automotive vehicle 10 is open and no identifying badge 16 is detected in the first area.

Again in the case where the scanning procedure is implemented with a view to locking or starting the automotive vehicle 10 if all the openings of the automotive vehicle 10 are closed and if no identifying badge 16 is detected in any one of the three areas 18, 20 and 22, the central control unit 12 determines whether at least one identifying badge 16 has been detected in any one of these three areas by the identification device 14, since detection of the final triggering event. If this is the case, the central control unit 12 orders the automatic locking of the automotive vehicle 10 then goes on to step 36 for stopping the procedure. Otherwise, step 36 for stopping the procedure is selected directly, without locking the automotive vehicle 10.

In all the other cases, step 36 for stopping the scanning process is selected directly.

The first scan, initiated in step 28, includes the repeated transmission, by the identification device 14, of identification requests for the attention of identifying badges 16 that may be located in the first scan area or the third scan area.

The second scan, initiated in step 30, includes the repeated transmission, by the identification device 14, of identification requests for the attention of identifying badges 16 that may be located in the first area.

Following step 28 or 30, during which one of the first and second scans was initiated, a step 32 for detecting an event temporarily stopping the scan initiated previously is selected. The detection of such an event provokes the stopping of the current scan followed immediately by the execution of the preliminary test by going back to step 26, for the purpose of executing a new scan, or followed by the repetition of the current scan without executing the preliminary test.

The set of temporary stop events comprises:

the detection of an identifying badge 16 in the first area 18, provoked by the insertion of this identifying badge 16 in the reader of the identification device 14;

the reception by the central control unit 12 of an action request considered by the latter to take priority over the current scan;

the opening of an opening of the automotive vehicle 10;

the closing of an opening of the automotive vehicle 10, if the latter is unlocked or locked from the inside; and the detection of the disappearance of an identifying badge 16 from the first area 18, provoked by the removal of this identifying badge 16 from the reader of the identification device 14.

In practice, the detection of an identifying badge 16 in the reader is a temporary stop event because the insertion of this badge 16 in the reader triggers, conventionally, a procedure to authenticate the latter. The scan is temporarily stopped to allow the identifying badge 16 to be authenticated, then resumes without executing the preliminary test of step 26.

An authentication of a badge inserted in the reader 14 is performed on executing a scan only if no identifying badge 16 has been authenticated previously.

If a priority action request reaches the central control unit 12, once this action is finished, one of the first and second scans is, where appropriate, repeated after executing the preliminary test of step 26.

Following step 32, a step 34 is selected for detection of an event permanently stopping the scan. If a permanent stop event is detected, step 36 is selected for stopping the scanning procedure, otherwise the scan continues until a new temporary or permanent stop event is detected.

The set of permanent stop events comprises:

the detection of a charge level in the battery of an identifying badge 16 present in at least one of the three scan areas 18, 20 and 22, below a predetermined threshold;

the detection of the end of a time delay initiated following a hands-free type locking of the automotive vehicle 10;

the detection of an instant of transition to a motor running state of the automotive vehicle 10; and the disappearance of all the identifying badges 16 from the three scan areas.

The first three permanent stop events are detected by the central control unit 12, whereas the final stop event, namely the disappearance of all the identifying badges 16, is detected by the identification device 14.

Figure 3:
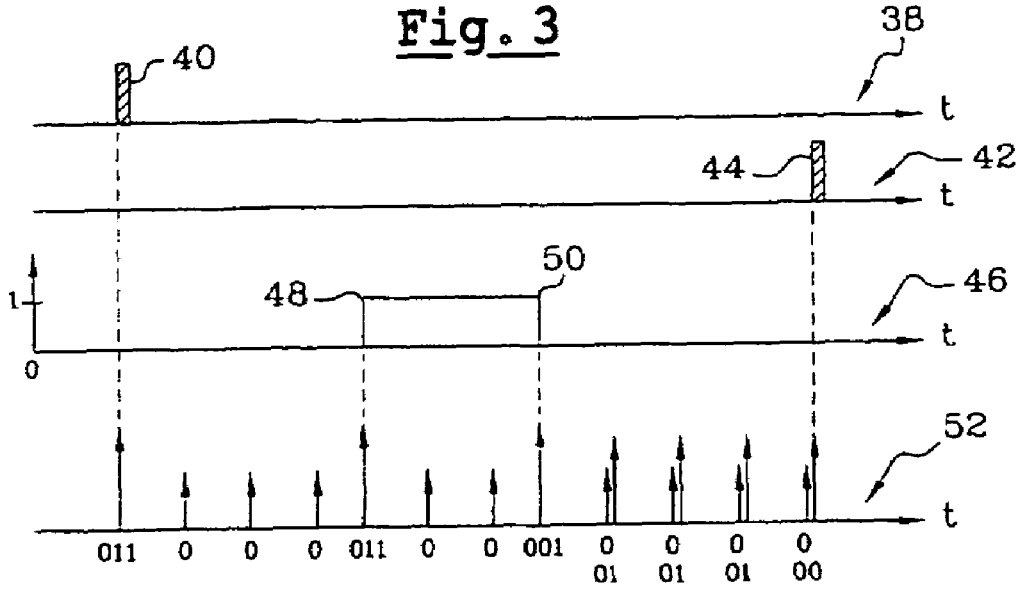
FIG. 3 represents a time chart detailing the operation of the scanning procedure of FIG. 2 in a particular case.

The time chart represented in FIG. 3 illustrates the operation of the scanning procedure described previously, in a particular case.

This time chart comprises a first line 38 representing the detection of a triggering event 40, a second line 42 representing the detection of a permanent stop event 44, a third line 46 representing the state of the openings of the automotive vehicle 10 and therefore representing the detection of temporary stop events, such as the opening 48 of an opening of the automotive vehicle 10 or the closing 50 of an opening of the automotive vehicle 10. These temporary stop events occur in time between the detection of the triggering event 40 and the detection of the permanent stop event 44. Finally, the chart includes a fourth line 52 representing some scan executions.

On detection of the triggering event 40, the identification device 14 sends, to perform the preliminary test, an identification request to the three scan areas. An identifying badge 16 is then detected in the second and third areas, which means that an identifying badge is inside the automotive vehicle 10. Since the openings of the automotive vehicle 10 are moreover all closed, step 30 is selected, during which the identification device 14 initiates a scan in the first area 18. During this scan, no identifying badge 16 is detected in the reader 14.

Next, the central control unit 12 detects the opening 48 of a door of the automotive vehicle 10. A preliminary test is then repeated during which it is observed that at least one opening of the automotive vehicle 10 is open and that no identifying badge 16 is inserted in the reader 14. The identification device 14 therefore initiates a further scan in the first area 18. During this scan no identifying badge 16 is detected in the reader 14.

Then, the central control unit 12 detects the closure 50 of the door previously opened. A preliminary test is then repeated indicating the presence of an identifying badge 16 outside the automotive vehicle 10, inside the third area 22. Since the openings of the automotive vehicle 10 are then all closed, step 28 is selected, during which a scan in the first and third areas is performed.

During this scan, an identifying badge 16 is detected in the third area, namely outside the automotive vehicle 10, up to a time of detection of a permanent stop event 44, upon which the identifying badge 16 detected outside the automotive vehicle 10 disappears. This disappearance is detected by the identification device 14 and causes all scans to be permanently stopped.

It seems clear that the identifying badge scanning procedure described previously provides for an effective and low-energy-intensive scan. Indeed, any scan is triggered or stopped on the basis of the detection of triggering events, temporary stop events or permanent stop events.

The invention claimed is:

1. A procedure for scanning identifying badges (16) for an automotive vehicle (10) comprising identifying badges and an identification device (14) suitable for the remote interchange of data with the identifying badges (16), the procedure comprising the following steps:

detecting (24) a triggering event from a predetermined set of triggering events;

executing (26) a preliminary test following the step of detecting the triggering event; and executing (28, 30) at least one badge scan from a set of scans according to the result of the preliminary tests, wherein the badge scan comprising a repeated transmission by the identification device (14) of identification requests to the identifying badges (16).

2. The procedure for scanning identifying badges (16) according to claim 1, wherein the identification device (14) is linked to a central control unit (12) designed to control the automatic locking means and the starting means of the automotive vehicle (10).

3. The procedure for scanning identifying badges (16) according to claim 1, wherein the scan (28, 30) is executed in at least one area (18, 20, 22) out of a set of predetermined areas.

4. The procedure for scanning identifying badges (16) according to claim 3, wherein the preliminary test (26) includes a test relating to the presence of at least one identifying badge (16) in at least one area (18, 20, 22) of all the predetermined areas.

5. The procedure for scanning identifying badges (16) according to claim 1, wherein the preliminary test (26) includes a test relating to the open or closed state of openings of the automotive vehicle (10).

6. The procedure for scanning identifying badges (16) according to claim 3, wherein the set of predetermined areas comprises a first area (18) located in a vicinity near to the identification device (14), a second area (20) corresponding to the passenger compartment of the automotive vehicle (10) and a third area (22) covering a given vicinity of the automotive vehicle (10).

7. The procedure for scanning identifying badges (16) according to claim 6, wherein the set of scans comprises a scan in the first area (18), a scan in the second area (20) and a scan in the third area (22).

8. The procedure for scanning identifying badges (16) according to claim 2, wherein the predetermined set of triggering events comprises a stopping of an engine of the automotive vehicle (10), an opening of at least one opening of the automotive vehicle (10), a closing of the at least one opening of the automotive vehicle (10) if the latter is unlocked or locked from the inside, an unlocking of the at least one opening of the automotive vehicle (10), a locking from the inside of the at least one opening of the automotive vehicle (10) and a reset of the central control unit (12) to an initial state, if the badge scan was in progress before this reset to the initial state.

9. The procedure for scanning identifying badges (16) according to claim 1, wherein the preliminary test (26) includes a step of verifying execution conditions of the badge scan, these conditions comprising a stopped state of an engine of the automotive vehicle (10) and an unlocked or locked state of at least one opening of the automotive vehicle (10) from the inside.

10. The procedure for scanning identifying badges (16) according to claim 1, wherein it also includes a step (32) of detecting an event of temporarily stopping the scan and a step (34) for detecting an event of permanently stopping the badge scan.

11. The procedure for scanning identifying badges (16) according to claim 10, wherein the temporary stop event comprises a detection of an identifying badge (16) in a first scan area (18), a reception by a central control unit (12) of an action request considered by the latter to take priority over the current scan an opening of an opening of the automotive vehicle (10) a closing of the opening of the automotive vehicle (10), if the latter is unlocked or locked from the inside and a detection of a disappearance of the identifying badge (16) from the first scan area (18).

12. The procedure for scanning identifying badges (16) according to claim 10, wherein the permanent stop event comprises a detection of a battery charge level on the at least one identifying badge (16) below a predetermined threshold a detection of the end of a time delay initiated following a hands-free type locking of the automotive vehicle (10), a detection of an instant of transition to an engine running state of the automotive vehicle (10) and a disappearance of all the identifying badges (16) from scan areas.

13. The procedure for scanning identifying badges (16) according to claim 6, wherein if the conditions for executing the badge scan are verified, if all openings of the automotive vehicle (10) are closed and if the at least one identifying badge (16) is detected in the third scan area, the execution of the badge scan in the first and third areas is initiated.

14. The procedure for scanning identifying badges (16) according to claim 6, wherein the execution of the badge scan in the first scan area is initiated, if the conditions for executing the badge scan and the following conditions are verified:

all the openings of the automotive vehicle (10) are closed the at least one identifying badge (16) is detected in the second and third areas and no badge is detected in the first area; or at least one opening of the automotive vehicle (10) is open and no identifying badge (16) is detected in the first area.

15. The procedure for scanning identifying badges (16) according to claim 14, wherein an authentication of the badge located in the first scan area is performed on executing the badge scan, only if no identifying badge (16) has been authenticated previously.

16. A procedure for scanning identifying badges (16) for an automotive vehicle (10) comprising identifying badges and an identification device (14) suitable for remote interchange of data with the identifying badges (16) and a central control unit (12) linked to the identification device (14), the procedure comprising the steps of:

detecting (24) a triggering event from a predetermined set of triggering events;

executing (26) a preliminary test including verification of conditions for execution of the badge scan only if the triggering event is detected; and executing (28, 30) at least one badge scan from a set of scans following the step of executing the preliminary test only when the conditions for execution are satisfied;

wherein the badge scan including a repeated transmission by the identification device (14) of identification requests to the identifying badges (16).

17. The procedure for scanning identifying badges (16) according to claim 16, wherein the predetermined set of triggering events comprises a stopping of an engine of the automotive vehicle (10), an opening of at least one opening of the automotive vehicle (10), a closing of the at least one opening of the automotive vehicle (10) if the latter is unlocked or locked from the inside, an unlocking of the at least one opening of the automotive vehicle (10), a locking from the inside of the at least one opening of the automotive vehicle (10) and a reset of the central control unit (12) to an initial state, if the badge scan was in progress before this reset to the initial state.

18. The procedure for scanning identifying badges (16) according to claim 16, wherein the conditions for execution of the badge scan include a stopped state of an engine of the automotive vehicle (10) and an unlocked or locked state of at least one opening of the automotive vehicle (10) from the inside.

19. The procedure for scanning identifying badges (16) according to claim 16, wherein the badge scan (28, 30) is executed in at least one area (18, 20, 22) out of a set of predetermined areas.

20. The procedure for scanning identifying badges (16) according to claim 19, wherein the preliminary test (26) includes a test related to the presence of the at least one identifying badge (16) in the at least one area (18, 20, 22) of the predetermined areas; and a test determining whether at least one opening of the automotive vehicle 10 is in an open or closed state.

21. The procedure for scanning identifying badges (16) according to claim 20, further including the step of locking openings of the automotive vehicle (10) if the test related to the presence of the at least one identifying badge (16) in the at least one area (18, 20, 22) of the predetermined areas is not satisfied.

* * * * *